US008833487B2

(12) United States Patent
Krueger, IV et al.

(10) Patent No.: US 8,833,487 B2
(45) Date of Patent: Sep. 16, 2014

(54) MECHANICAL SPECIFIC ENERGY DRILLING SYSTEM

(75) Inventors: Rudolf Ernst Krueger, IV, Cypress, TX (US); Philip Wayne Mock, Costa Mesa, CA (US); Norman Bruce Moore, Aliso Viejo, CA (US)

(73) Assignee: WWT North America Holdings, Inc., Houston, TX (US)

( * ) Notice: Subject to any disclaimer, the term of this patent is extended or adjusted under 35 U.S.C. 154(b) by 271 days.

(21) Appl. No.: 13/442,642

(22) Filed: Apr. 9, 2012

(65) Prior Publication Data

US 2012/0261190 A1 Oct. 18, 2012

Related U.S. Application Data

(60) Provisional application No. 61/475,596, filed on Apr. 14, 2011, provisional application No. 61/530,842, filed on Sep. 2, 2011, provisional application No. 61/612,139, filed on Mar. 16, 2012.

(51) Int. Cl.

| | |
|---|---|
| ***E21B 44/00*** | (2006.01) |
| ***E21B 45/00*** | (2006.01) |
| ***E21B 4/18*** | (2006.01) |
| ***E21B 44/04*** | (2006.01) |

(52) U.S. Cl.

CPC ..... *E21B 44/005* (2013.01); *E21B 45/00* (2013.01); *E21B 4/18* (2013.01); *E21B 44/04* (2013.01)

USPC ..... 175/24; 175/40

(58) Field of Classification Search

USPC ..... 175/24, 27, 40

See application file for complete search history.

(56) References Cited

U.S. PATENT DOCUMENTS

| | | | | |
|---|---|---|---|---|
| 4,348,058 | A | 9/1982 | Coakley et al. | |
| 4,351,037 | A | 9/1982 | Scherbatskoy | |
| 4,662,458 | A * | 5/1987 | Ho | 175/27 |
| 5,467,832 | A | 11/1995 | Orban et al. | |
| 7,854,275 | B2 | 12/2010 | Mock et al. | |
| 8,146,680 | B2 | 4/2012 | Mock et al. | |
| 2006/0162962 | A1 | 7/2006 | Koederitz et al. | |
| 2008/0249714 | A1 | 10/2008 | Calhoun et al. | |
| 2009/0090555 | A1 * | 4/2009 | Boone et al. | 175/45 |
| 2009/0173540 | A1 | 7/2009 | Mock et al. | |
| 2010/0108383 | A1 | 5/2010 | Hay et al. | |

OTHER PUBLICATIONS

Dupriest, F.E., et al. "*Maximizing ROP with Real-Time Analysis of Digital Data and MSE*", IPTC 10607, presented at the International Petroleum Technology Conference, Doha, Qatar, Nov. 21-23, 2005, 8 pages.

Dupriest, F.E., et al. "*Comprehensive Drill-Rate Management Process to Maximize Rate of Penetration*", SPE 102210, presented at the 2006 SPE Annual Technical Conference and Exhibition, San Antonio, Texas, Sep. 24-27, 2006, 9 pages.

(Continued)

*Primary Examiner* — William P Neuder

(74) *Attorney, Agent, or Firm* — Christie, Parker & Hale, LLP

(57) ABSTRACT

A mechanical specific energy downhole drilling assembly having a bottomhole assembly including drill pipe and a drill bit, a weight on bit and torque sub for sensing torque, weight on bit and revolutions per minute of the drill bit; a command and control sub for receiving input from the weight on bit and torque sub for determining instantaneous mechanical specific energy of the downhole drilling assembly and an anti-stall tool responsive to real time mechanical specific energy information from the command and control sub to adjust the weight on the drill bit to maximize rate of penetration of the drill bit.

20 Claims, 7 Drawing Sheets

(56) References Cited

OTHER PUBLICATIONS

Remmert, S.M., et al. "*Implementation of ROP Management Process in Qatar North Field*", SPE/IADC 105521, presented at the SPE Drilling Conference, Amsterdam, The Netherlands, Feb. 20-22, 2007, 10 pages.

Teale, R. "*The Concept of Specific Energy in Rock Drilling*", Int. J Rock Mech. Mining Sci. vol. 2, pp. 57-73, Pergamon Press, Great Britain, 1965.

Pink, T., et al. "*Building an Automated Drilling System Where Surface Machines are Controlled by Downhole and Surface Data to Optimize the Well Construction Process*", IADC/SPE 150973, presented at the IADC/SPEA Drilling Conference and Exhibition, San Diego, California, USA, Mar. 6-8, 2012, 9 pages.

Pessier, R., et al. "*Drilling Performance is a Function of Power at the Bit and Drilling Efficiency*", IADC/SPE 151389, presented at the IADC/SPE Drilling Conference and Exhibition, San Diego, California, Mar. 6-8, 2012, 16 pages.

Pessier, R., et al. "*The Bit Effect on Drilling Mechanics*", presented at the SPE Drilling Seminar, Houston, Texas, 2009 (print version Oct. 25, 2010), 23 pages.

Chapman, C. D., et al. "*Automated Closed-loop Drilling with ROP Optimization Algorithm Significantly Reduces Drilling Time and Improves Downhole Tool Reliability*", IADC/SPE 151736, presented at the IADC/SPE Drilling Conference and Exhibition, San Diego, California, Mar. 6-8, 2012, 7 pages.

International Search Report and Written Opinion issued from the International Searching Authority for International Application No. PCT/US12/33313; date of completion Jun. 26, 2012; date of mailing Jul. 5, 2012; 12 pages.

* cited by examiner

MECHANICAL SPECIFIC ENERGY DRILLING SYSTEM

CROSS-REFERENCE TO RELATED APPLICATION(S)

This application claims priority to U.S. Provisional Application No. 61/475,596, filed Apr. 14, 2011; U.S. Provisional Application No. 61/530,842, filed Sep. 2, 2011 and U.S. Provisional Application No. 61/612,139, filed Mar. 16, 2012, the contents of which are incorporated herein by reference.

BACKGROUND OF THE INVENTION

Several authors in both major oil companies and major equipment suppliers have promulgated the use of optimized drilling oil and gas wells rate of penetration (ROP) with a system that attempts to measure the mechanical specific energy (MSE) of the drilling process.

The concept of MSE in rock drilling was formulated by Teale in the 1960's and has been used by several drill bit manufactures as a measure of drilling efficiency. Two operators made significant progress in increasing drilling rates using an MSE based system on oilfields in Qatar. The significant accomplishment of this process was a faster rate of penetration of 20-250% as seen in hole sizes from 17½ inch to 8½ inch in vertical and build sections, with the greatest improvement in the 17½ vertical section.

The use of MSE as promulgated by another author Dupriest, involves both technology and workflow. Regarding the technology, MSE is calculated continuously by a data acquisition system supported by information from either surface equipment or downhole tools such as a measurement-while-drilling (MWD) downhole tool and a vibration sensor tool. In addition, sometimes rock characteristics (and associated bit aggressiveness) is used as information in assessing downhole drilling performance, which is usually done offline to the drilling process. The information is then displaced to the drilling operator who intervenes in the process by making adjustments to the drilling process, usually adjusting the weight on bit (WOB). Other adjustments include changing the RPM or increasing the hydraulic specific energy (mud flow rate).

The inherent limitations of the system described above are 1) when relying on surface measurements, no direct measurement of the effects from the drill string to the formation and casing are included, thus potentially masking downhole problems, 2) when using downhole equipment for measurements, the time delay from instrumentation measurement to operator response (assuming he knows the correct response), and 3) significant expense in training, equipment, system monitoring of the process, especially the workflow process.

Consequently a need exists for a self-contained, automatic feedback, real time, downhole assembly that provides optimization of the ROP via the control of the MSE. The present invention circumvents the limitations above and offers the opportunity for all the benefits of increased ROP resulting in less drilling cost per well.

SUMMARY OF THE INVENTION

The present invention provides a downhole drilling assembly and drilling method to increase and maximize rate of penetration (ROP). The present invention is directed to a mechanical specific energy downhole drilling assembly (MSE-DDA) which consists of several sensing assemblies, a computerized downhole computation capability, and a controlled downhole weight modification tool. The drilling method used with the MSE-DDA consists of making various initial calibration steps when the MSE-DDA is initially downhole, then when drilling ahead making some significant adjustments in WOB when major drilling conditions change such as change in formations. The range of the adjustments may vary from minor (called herein as "trimming") to major (herein meaning greater than 50% of the adjustments applied from the surface to the drill string).

The process of using the MSE-DDA is the following. The driller runs the bottom hole assembly (BHA) with the MSE-DDA into the hole and starts drilling with a preferred set of drilling parameters including WOB, drilling fluid circulation rate (flow rate), drill string torque (T), and rotation rate (RPM) of the drill string. The MSE-DDA, which is equipped with a sensing device that signals to turn on the assembly via a pressure signal from the surface such as switching the pressure pumps on three times in a specific time interval, is turned on. The MSE-DDA receives real time measured drilling parameters including WOB, T at the bit, RPM of the bit, and other information about the hole diameter and drill bit aggressiveness parameters supplied, and then determines the instantaneous MSE. With the instantaneous MSE computed, the time averaged MSE is updated and compared to recent drilling history MSE. The comparison of the updated MSE to the previous time averaged MSE determines if the WOB is appropriate (unchanged, increasing, or decreasing). A command is then sent to a controlled downhole weight modification tool such as an anti-stall tool (AST) as disclosed in U.S. Pat. No. 7,854,275, and U.S. patent application Ser. No. 12/348,778 the contents of which are incorporated herein by reference, which then adjusts the WOB appropriately (holding constant, decreasing or increasing), thus maximizing the ROP for the near-bit drilling conditions. The drilling process then adjusts via the drill string to the new conditions of altered WOB. This feedback loop continues throughout the drilling of the hole section with little or no intervention of the driller.

The method of using the MSE-DDA is the following. The MSE-DDA is incorporated in the BHA. The known range of anticipated parameters are programmed into the MSE-DDA at the surface; these include bit diameter, hole area, and ranges for RPM, WOB, and bit aggressiveness in the anticipated formation. The BHA is run into the hole, the MSE-DDA is turned on, and drilling begins with the anticipated drilling parameters of WOB, RPM, mud properties, and T. A range of drilling parameters are then run for the drilling of a particular hole section. For example, the RPM range will be operated at a fixed WOB, then the WOB will be varied at several RPM, then the hydraulic horsepower (HIS) can be varied over a typical range of operation. Changes in drilling fluids or additives to drilling fluids could also be calibrated in this manner. The MSE-DDA will then use this information as a database for modification while operating down hole.

In addition, when a downhole motor is part of the BHA, the AST can be directed to reduce WOB during a motor stall; this process can be conducted as a separate command to the AST, thus allowing simultaneous and prioritized commands to reach the AST for proper immediate action. Such action could prevent damage to a stalled downhole motor for example. This process would continue until the target depth (TD) is reached.

The MSE-DDA effectively makes "trimming" adjustments to the WOB in real time maximizing the ROP without major changes in drilling procedures, thus reducing drilling costs significantly.

DETAILED DESCRIPTION OF THE INVENTION

Figure 1:
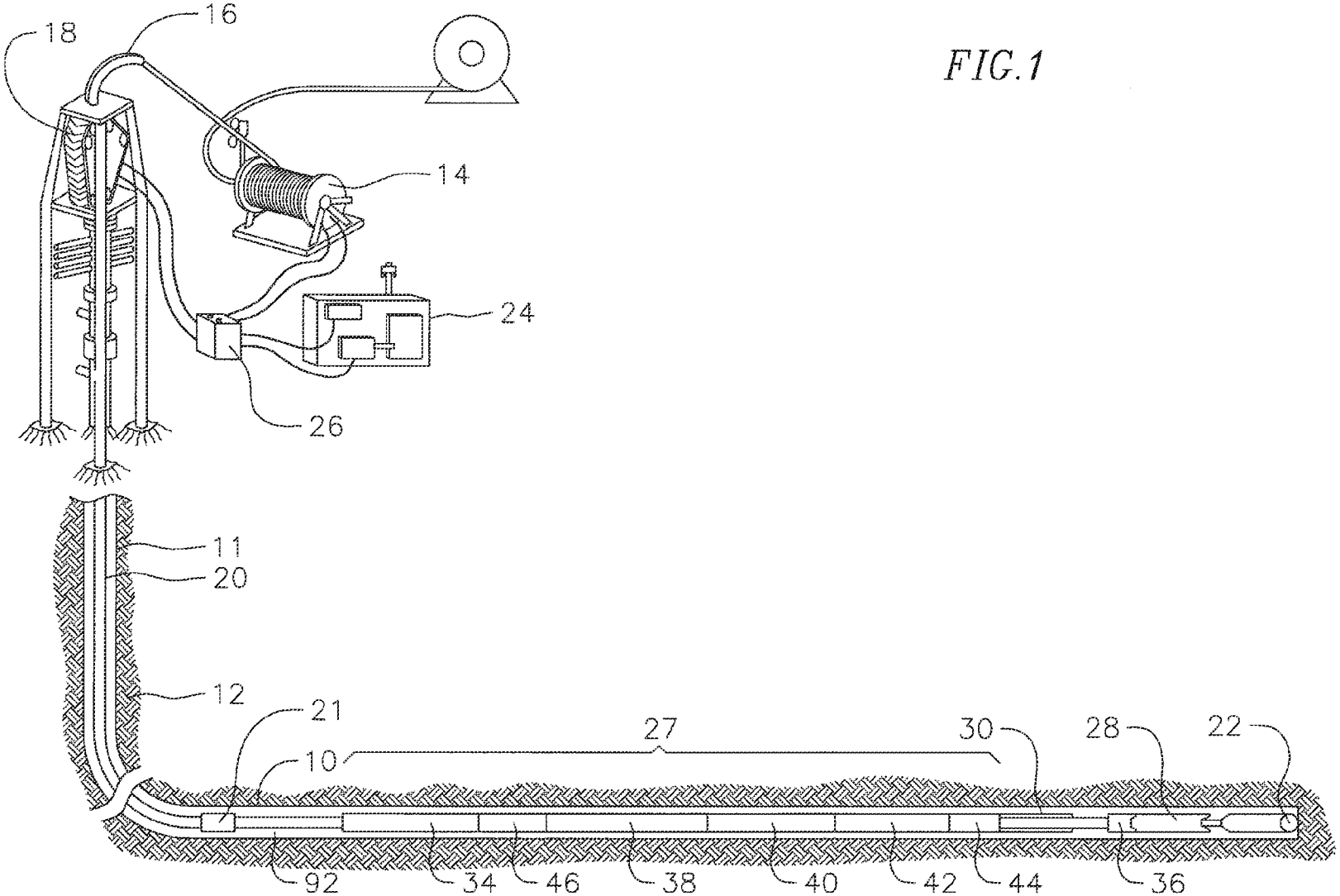
FIG. 1 is a schematic view of a drilling apparatus of the present invention.

FIG. 1 is a schematic diagram illustrating a coiled tubing drilling system 10 for drilling a well bore 11 in an underground formation 12. The coiled tubing drilling system can include a coiled tubing reel 14, a goose neck tubing guide 16, a tubing injector 18, a coiled tubing 20, a coiled tubing connector 21, and a drill bit 22 at the bottom of the well bore. FIG. 1 also shows a control cab 24, a power pack 26, and an alignment of other BHA tools at 27, which will be discussed in more detail subsequently herein. During drilling, the downhole equipment includes a downhole motor 28, such as a positive displacement motor (PDM), for rotating the drill bit. An anti-stall tool (AST) 30 is positioned near the bottom of the coiled tubing, upstream from the downhole motor and the drill bit. Although a coiled tubing drilling system is illustrated, it is to be understood that the MSE-DDA of the present invention is equally applicable to other drilling system formats.

For this invention, the controlling metric is the MSE. The objective of efficient drilling is to minimize the MSE in the particular hole section, the contra-positive is higher than minimum MSE is inefficient drilling. MSE is defined in the following terms:

$$\text{MSE}=\text{Input Energy/Output ROP} \quad \text{Eq. 1:}$$

$$\text{MSE}=1/\text{drilling efficiency} \quad \text{Eq. 2:}$$

$$\text{MSE}=\text{WOB}/A+120*\text{pi}*T*N/(A*R) \quad \text{Eq. 3:}$$

Or when indirect measurements are not available, Eq. 3 can be written in terms of WOB and bit aggressiveness.

$$\text{MSE}=\text{WOB}/A+13.33*u*\text{WOB}*N/(D*\text{ROP}) \quad \text{Eq. 4:}$$

Where:

WOB=Weight on Bit (lb)

T=Torque (ft-lbs)

ROP=Rate of Penetration (ft/hr)

A=Area of Hole (sq in)

D=Bit diameter (in)

N=RPM (rev/min)

u=bit aggressiveness varies with bit and formation

| Bit Type | Typical values for u |
|---|---|
| Steel Tooth Bit | 0.15-0.26 |
| Tungsten Carbide Insert | 0.12-0.26 |
| Poly Crystalline Diamond | 0.6-1.4 |
| Diamond Impregnated bit | 0.3-0.6 |
| Hybrid | 0.2-0.8 |

For the invention, the application of this method to minimize MSE requires the active real-time measurement of the drilling parameters of WOB, T, N and alternatively u (bit aggressiveness input from previous experience) along with the known parameters of A and D. With the calculation of the metric MSE completed, commands are given to a downhole tool to adjust the amount of force on the bit (or bit hydraulics). Next a feedback loop via the drill string reaction and the MSE-DDA measures the change in the MSE and then orders modification of the WOB. Then the feedback loop repeats itself and self adjusts or "trims" the drilling parameters to minimize the MSE.

In general, the MSE is a multiple (typically 3) of the compressive strength of the rock. For example, if the anticipated compressive rock strength in a hole section is expected to be 10,000 psi, efficient drilling will be at MSE of approximately 3,300 psi. The corollary is that if the MSP is above 3,300 psi, the system is not drilling efficiently and adjustments need to be made.

It can be seen that the effects of the MSE-DDA can have a wide range. For example, most applications and especially smaller hole sizes, the MSE-DDA will contribute a significant modification of the major drilling operational changes implemented from the surface. For example, the surface driller may want to apply 15,000 lbs WOB, but the MSE-DDA might apply an additional 10,000 lbs in one set of drilling conditions and in another formation decrease the load 10,000 lbs. For a larger hole with 25,000 lbs WOB, the MSE-DDA might contribute 5,000 lbs, and thus "trimming" the MSE and ROP.

An example of the use of this algorithm is shown in Table 1.

TABLE 1

Examples of Several Drilling Conditions and Automatic Response by MSE-DDA Changing Conditions.

| Parameter | Scenario 1 | Scenario 2 | Scenario 3 | Scenario 4 | Scenario 5 | Scenario 6 |
|---|---|---|---|---|---|---|
| RPM | Baseline | Baseline | Baseline | Baseline | Baseline | Baseline |
| Torque | Baseline | Baseline | Baseline | Baseline | Large variations | Large Variations |
| WOB | Baseline | Baseline | Above Baseline | Baseline | Variations | Large variations |
| Mud Flow Rate | Baseline | Baseline | Baseline | Baseline | Baseline | Baseline |
| Vibrations | Baseline | Baseline | Baseline | Lateral vibration dominate | Torsional vibrations dominate | Impact-like torsional changes |

TABLE 1-continued

Examples of Several Drilling Conditions and Automatic Response by MSE-DDA Changing Conditions.

| Parameter | Scenario 1 | Scenario 2 | Scenario 3 | Scenario 4 | Scenario 5 | Scenario 6 |
|---|---|---|---|---|---|---|
| MSE | Baseline, but increasing WOB increase MSE | High | Very High | High, with large variations | High with large variations | High with large variations |
| Problem | Insufficient WOB | Bit Balling | Bottom hole Cleaning | Lateral Vibrations | Torsional Vibrations (stick-slip) | Drill String Buckling (whirl) |
| Required Action | Increase WOB | Increase bit hydraulics | Increase bit hydraulics | Increase WOB, reduce RPM | Reduce WOB, increase RPM | Reduce WOB |

Scenario 1: Laminated strata of rock of different hardness are transitioned such as shale to sandstone or dolomite to shale.
Scenario 2: Soft formation, frequently shale, with low compressive strength, such as shale
Scenario 3: Hard formation, but not extremely hard formation.
Scenario 4: Relatively clean, but hard formation such as hard dolomite and anhydrite with compressive strength above 25 Ksi.
Scenario 5: Soft formation when drilling with aggressive bit or excessive WOB, producing stick-slip in the drill string.
Scenario 6: Independent of formation, this scenario is primarily in long horizontal wells, especially with high tortuosity, high drag into the hole.

Although the various drilling parameters can be estimated at the surface; these characteristics are more accurately measured in close proximity to the drill bit, thereby avoiding misinterpretation of information because of drag in the drill string, drill string buckling and associated whirl, and lateral vibrations.

Figure 2:
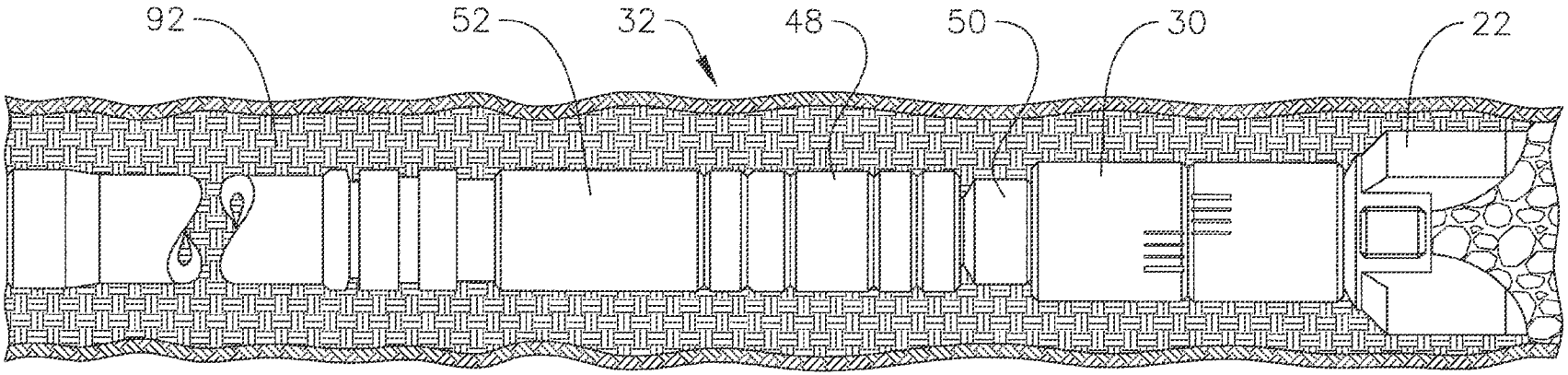
FIG. 2 is a side view of a portion of the drilling system of FIG. 1 illustrating a bottom hole assembly containing a mechanical specific energy drilling system.

Referring to FIG. 2, a mechanical specific energy downhole drilling assembly (MSE-DDA) 32 of the present invention is illustrated. In order to achieve active feedback to the drill bit 22, several components with different functions are incorporated into the BHA. BHA vary widely depending upon the hole size, hole inclination, and formation; however, all BHA include a drill bit 22 to remove the rock, drill pipe 20 (drill pipe, heavy weight drill pipe, drill collars 21) to deliver drilling fluid and provide weight to the bit, and almost all include a measurement-while-drilling (MWD) tool 34 (FIG. 1) to determine location.

As shown in FIG. 1, other drilling tools frequently found in a BHA include a downhole motor 28, a bent-sub downhole motor 36, a jar and vibration-inducing tool 38, a rotary steering tool (RSS) 40, a logging-while-drilling (LWD) tool 42, WOB sub (tension, compression, torque), a vibration measurement tool 44, a mud pulse telemetry sub 46 (frequently part of the MWD) and other special purpose tools.

The BHA of the MSE-DDA of the present invention includes other tools (typically called subs) with specialized functions to measure the parameters as defined in Equations 3 and 4, to process the information, to apply weight to the bit that is supplemental to that applied at the surface, and to provide a feedback loop to maintain optimum conditions.

As shown in FIG. 2, to measure the weight on bit and torque, a WOB and torque sub (WOB/TS) 48 is incorporated into the assembly. These subs are commercially available from multiple suppliers including Antech of the UK and other lower tier oilfield equipment suppliers. Other suppliers provide a drilling sensor sub that measures the WOB, torque, annulus pressure, and downhole temperature. The sub 48 could be either battery powered or powered by a mud turbine. The output of from the WOB/TS is delivered to a command and control sub (CCS) 50.

The CCS 50 will have multiple channels (at least 4) for delivery of electrical signals from the WOB/TS 48 and the a rate of penetration sub (ROPS) 52 discussed herein. The CCS includes a computation capability in the form of a programmable logic controller, embedded control and acquisition device, or other computer, appropriate software, and at least one or a multiplicity of electrical channels to output to an anti-stall tool (AST) 30 providing commands to either increase or decrease the WOB from the AST. Components in the CCS would include commercially available parts. For example, a National Instruments embedded device (reconfigurable field-programmable gate array (FPGA) and real time processor with electronic storage), a National Instruments analog input/output device, device specific programming software, and a USB access port. The electronics are contained in an atmospheric chamber, and have external interface through appropriate water and pressure resistant electrical connections. The electronics are qualified to tolerate operation at 150° C. The CCS would be powered either by battery or turbine generator and could provide power to the other subs in the MSE-DDA.

The ROPS 52 is a tool that measures distance traversed into the hole over a specific time interval, hence the ROP (axial velocity) of the BHA. The distance traversed can be measured by various means including the use of multiple calibrated wheels on the outside of the sub which counts the number of revolutions per unit time, which is then converted to ROP. An alternative configuration is defined in U.S. Pat. No. 7,058,512 which describes a sub containing an axial accelerometer; the output from the accelerometer is then numerically integrated over time to determine the axial velocity of the assembly. The ROPS is powered either by battery or turbine generator. Alternatively, if an MWD system is available, the MWD could determine the ROP of the assembly at the bottom of the hole, and either directly deliver the information to the MSE-DDA or it can send the velocity information to the surface and then sent back down to the MSE-DDA.

The function of the AST 30 is to adjust the WOB by application of force via pistons. The force from the pistons is created from pressure controlled by electrically controlled valves. Operation of the valves allows the entrance and exit of pressurized drilling fluid to enter chambers that through a shaft increases or decreases force on the bit as disclosed in detail in U.S. patent application Ser. No. 13/267,654, incorporated herein by reference. The AST is in electrical communication to the CCS which is in constant communication to the WOBS, thus providing a constant feedback control loop for controlling the weight on bit.

Figure 3:
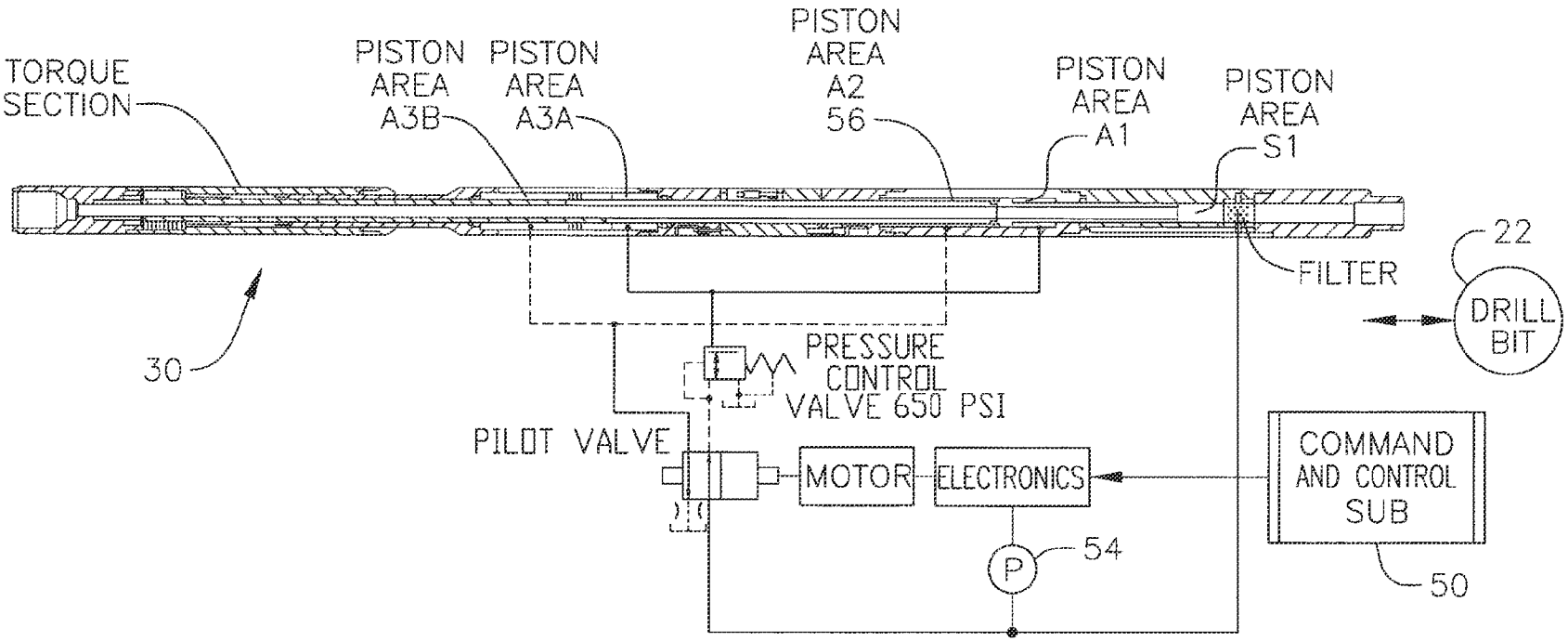
FIG. 3 is a schematic view of an AST of the apparatus of FIG. 2.

In addition, the AST 30 is also equipped with a pressure transducer 54 that monitors the annulus pressure. When drilling with a downhole motor 26, the pressure sensor can detect a motor stall via an increase in annulus pressure and then adjust the weight on the bit via the pressurized chambers with pistons 56 to relieve the pressure and prevent the motor stall. FIG. 3 shows a schematic of the AST interfacing to the CCS 50 and the drill bit 22. Although FIG. 2 illustrates the CCS, WOB/TS, and ROPS as separate components, they can be combined into one sub for ease of field operations and system compaction. Further, all these components can be combined into a single tool for the ease of operation, ease of maintenance, ease of running in the hole, or other reasons.

Figure 4:
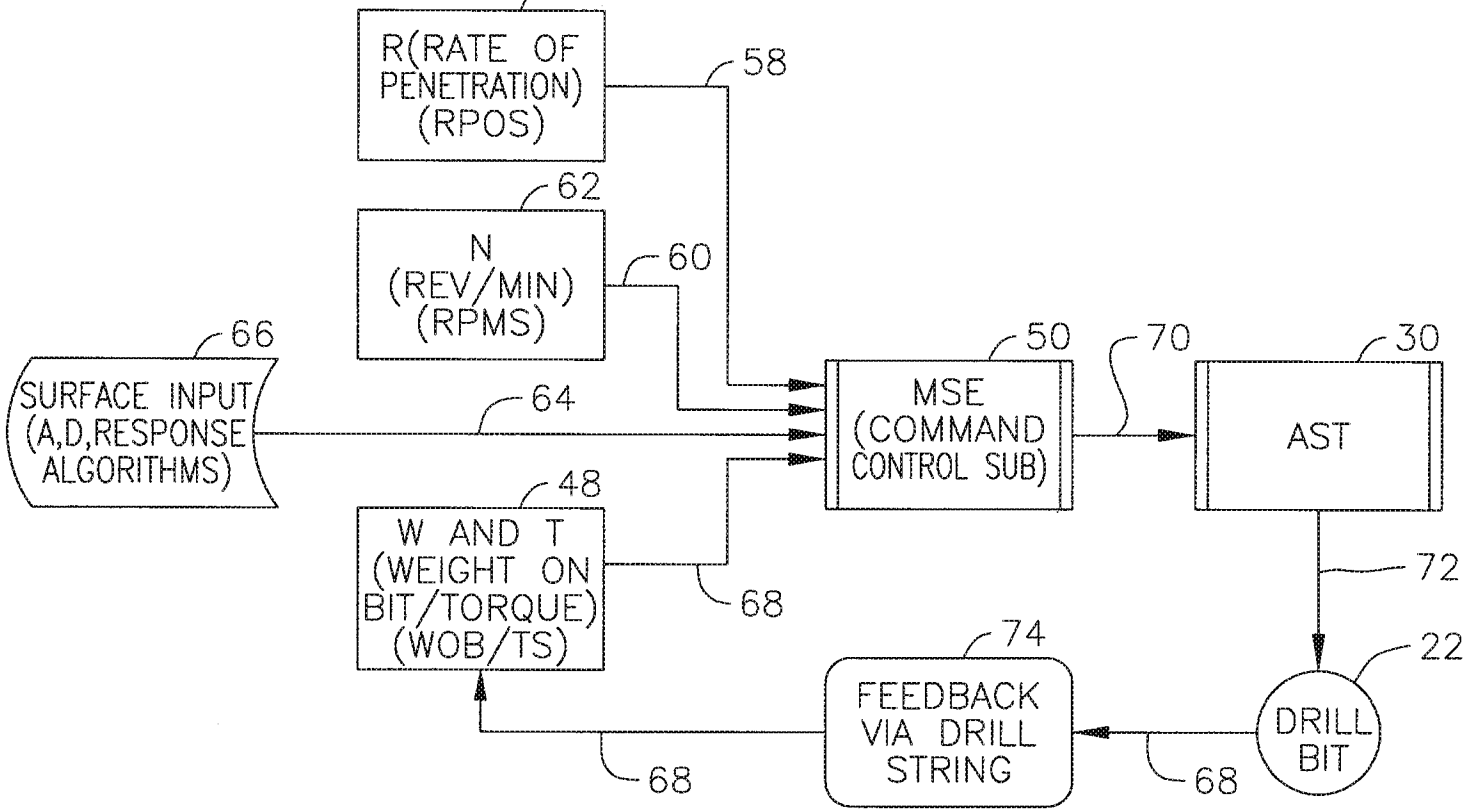
FIG. 4 is a flow diagram of the function of the system of FIG. 2.

FIG. 4 illustrates a flow chart for the function of the MSE-DDA. The CCS 50 includes multiple channels for the receipt of electrical signals to program the sub. FIG. 4 illustrates four channels for the delivery of a rate of penetration signal (R) 58 from the ROPS 52; a revolutions per minute signal (N) 60 from the RPMS 62; area of the hole (A) and bit diameter (D) signals 64 which are known parameters programmed in from the surface 66; and weight on bit and torque signals (W) and (T) 68 from the WOB/TS 48. The CCS has an output channel to send a command signal 70 to the AST 30 to either hold, increase or decrease force 72 to the drill bit 22 to adjust the weight on bit. The WOB/TS 48 is in constant communication with the CCS by receiving weight on bit and torque signals 68 from the drill bit thus providing a constant feedback control loop 74 for controlling the weight on bit.

Figure 5:
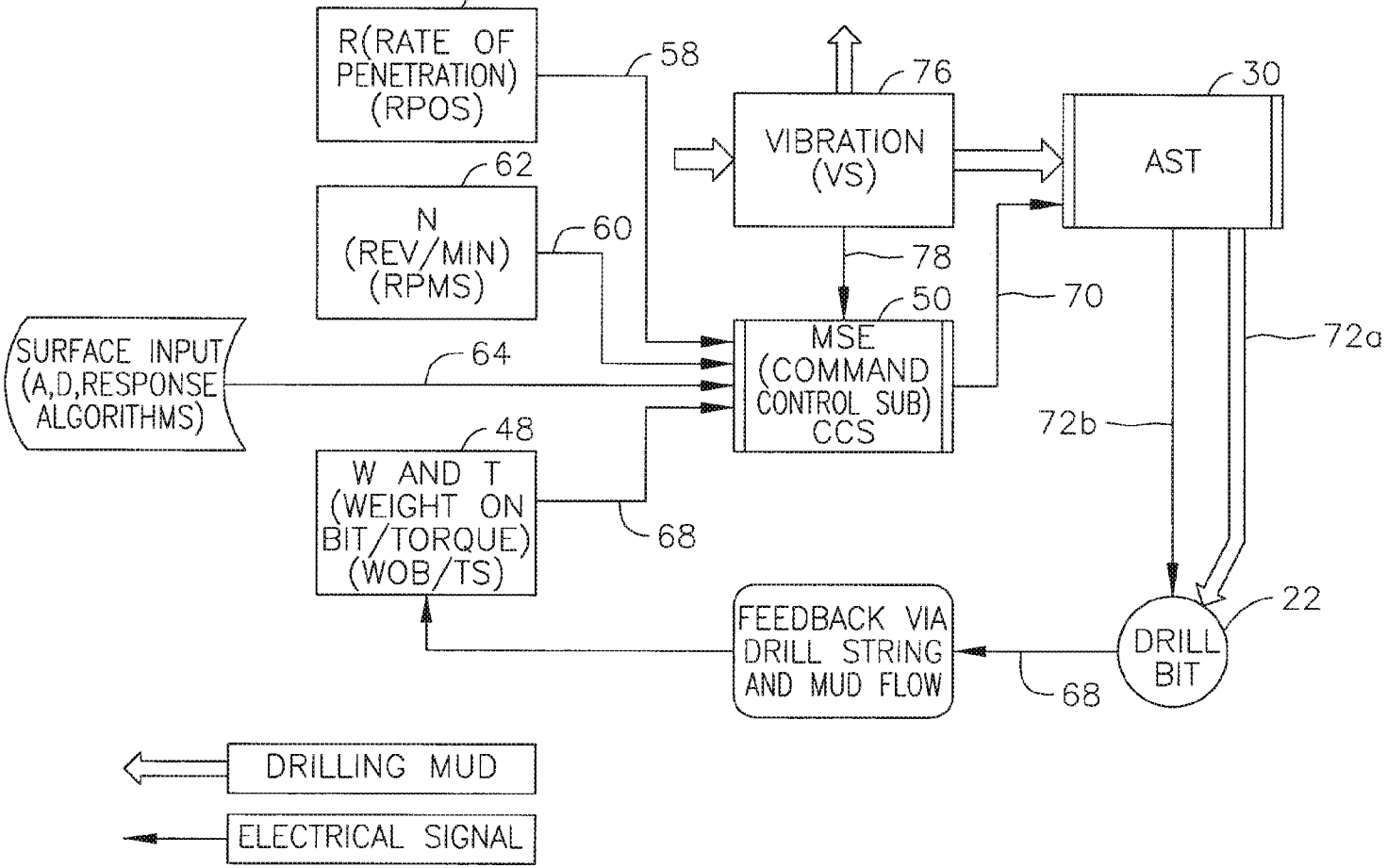
FIG. 5 is a flow diagram of the function of the system of FIG. 2 further incorporating a vibration sub.

The MSE-DDA of FIG. 2 can incorporate a sensor package that measures various vibrations occurring near the drill bit. A vibration sub (VS) 76 is incorporated into the MSE-DDA configuration as shown in FIG. 5. The VS can be a separate tool that interfaces with the CCS 50 or it can be integrated into the one or all the other subs. For example, the VS 76 could be integrated into the WOB/TS.

The VS will monitor all vibration modes; axial, lateral, and torsional. For reference, axial mode is vibration along the longitudinal axis of the BHA. Lateral mode is transverse to the longitudinal axis of the BHA. Torsional mode is twisting along the axis of the BHA. Conventional drilling experience has shown that axial vibration is relative infrequent; however, high levels of 5-20 G lateral vibration is of significant importance as it limits ROP. Torsional vibration (also called stick slip) of 5-20 G can limit ROP for some bit selections, depending on formation characteristics.

The VS would include internal instrumentation such as solid state multi-axis accelerometers to measure the amount of the acceleration in each axis. The vibration signal 78 from the accelerometers would be sent to the CCS for amplification, signal conditioning and processing. Power for the VS would be provided via the CCS. The CCS will have a preprogrammed algorithm that provides command signals 70 to the AST in response to a particular vibration from the various measured levels of vibration. For example, lateral vibration of 5-10 Gs indicates the need to apply additional WOB 72*a* via the AST. The application of additional WOB via the AST would be proportional to the acceleration level. Similarly, acceleration levels of 5-10 Gs torsionally would require reducing the weight on bit 72*b*. Vibration subs are commercially available such as from Tomax which uses a torsional spring that uses weight on bit on response to torsional vibration.

Figure 6:
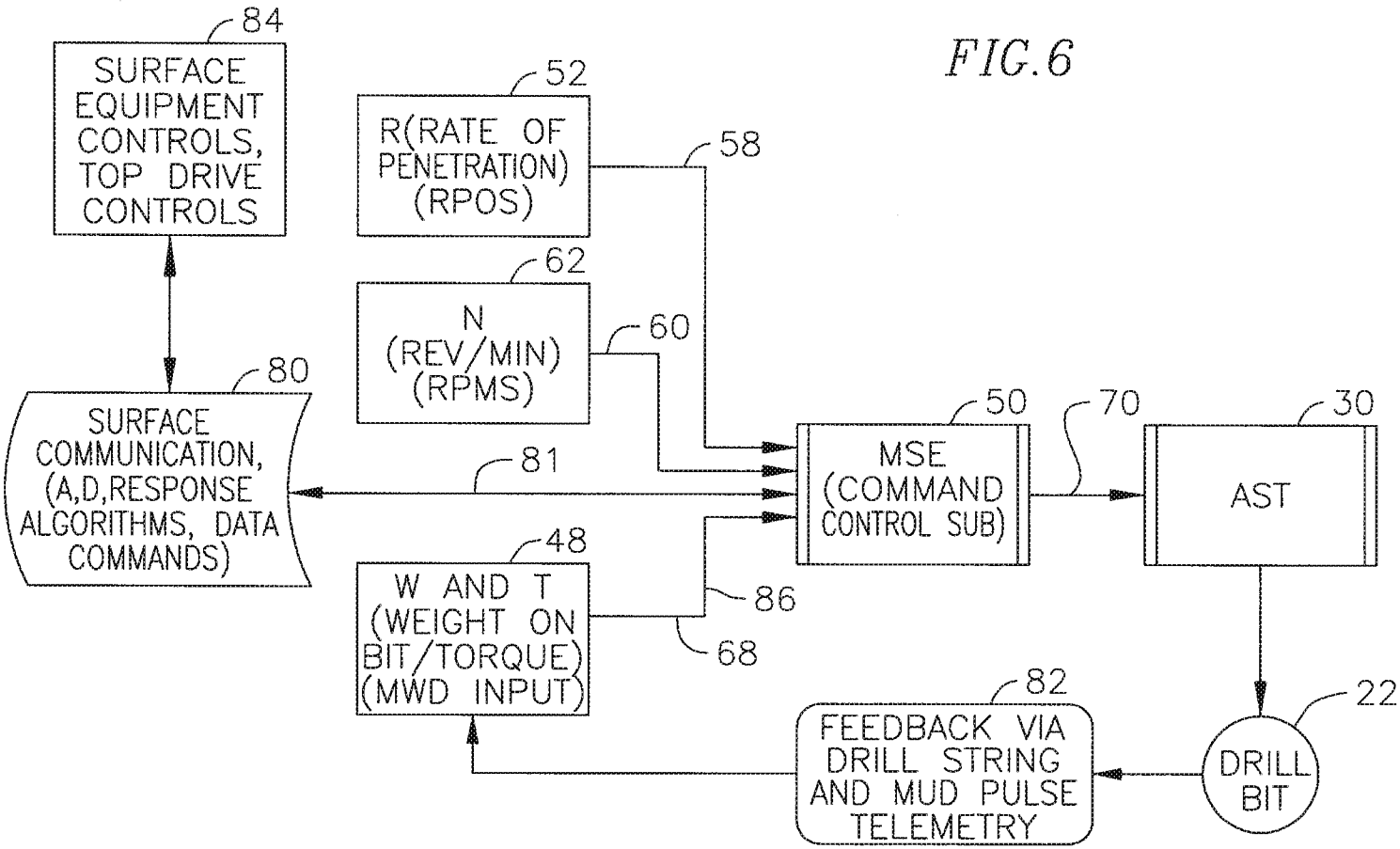
FIG. 6 is a flow diagram of the function of the system of FIG. 2 further incorporating surface communication equipment.

As shown in FIG. 6, the MSE-DDA can also incorporate communication to the surface 80 and commands 81 to the MSE-DDA from a MWD tool 34. The MWD tool locates the drilling assembly in three dimensional space and conveys the information to the surface, typically via mud pulse telemetry 82 from the tool to the surface equipment 84. At the surface the driller acts on this information with various actions. A MWD tool is commercially available from Halliburton, Schlumberger, Weatherford, and many lower tier suppliers.

For example, if the MWD indicates that the drilling assembly is deviating from its desired trajectory and if the BHA includes a bent downhole motor 36 (FIG. 1), the driller would stop drilling, change the orientation of the bent motor and then continue drilling. The MWD first sends information to the surface and later is given commands to continue measurements via signals sent via mud pulse telemetry. This communication from the bottom of the hole to the top can take 2-5 minutes, depending upon the depth of the hole. This embodiment of the MSE-DDA utilizes the existing communication system from commercially available MWD providers to provide direct signals and commands 86 to the MSE-DDA.

Further, the MWD tool 34 can provide additional information such as WOB and T signals 68, which is incorporated into the tool. All measurements of position as well as WOB and T are conveyed to the surface and commands are sent via mud pulse telemetry. In this embodiment, some of the necessary information, such as WOB, T for the CCS is provided by the MWD tool. Again in this configuration, measurements of the WOB and T are sent to the CCS, along with N 60 from the RPMS 62. The information is processed by the CCS and commands 70 sent to the AST 30. At programmed intervals, the information from the MWD, CCS and AST are sent to the surface for review by the driller.

This is significant in that of the energy applied at the top of a drill string, various estimates are that only 25-10% of the energy and applied weight of prior systems is actually delivered to the drill bit for drilling. The MSE-DDA of the present invention delivers its WOB and energy almost completely to the drill bit. The MSE-DDA can be interfaced with these other systems thus providing control of the drilling process both from the top of the drill string and at the bottom. The interfacing controls allow gross changes in drilling parameter from the top and refined and extraordinarily fast response directly at the bit. Thereby providing the most complete and comprehensive controls for the drilling process. The primary automated surface controls 84 will be through the top drive equipment that rotates and moves the drill pipe into and out of the well. By adjusting the power, speed, torque and hook load from the top drive the RPM, WOB, ROP of the bit are affected less by the parasitic losses of friction of the drill pipe against the casing, top drive efficiency losses, drilling mud hydraulics losses and others.

Figure 7:
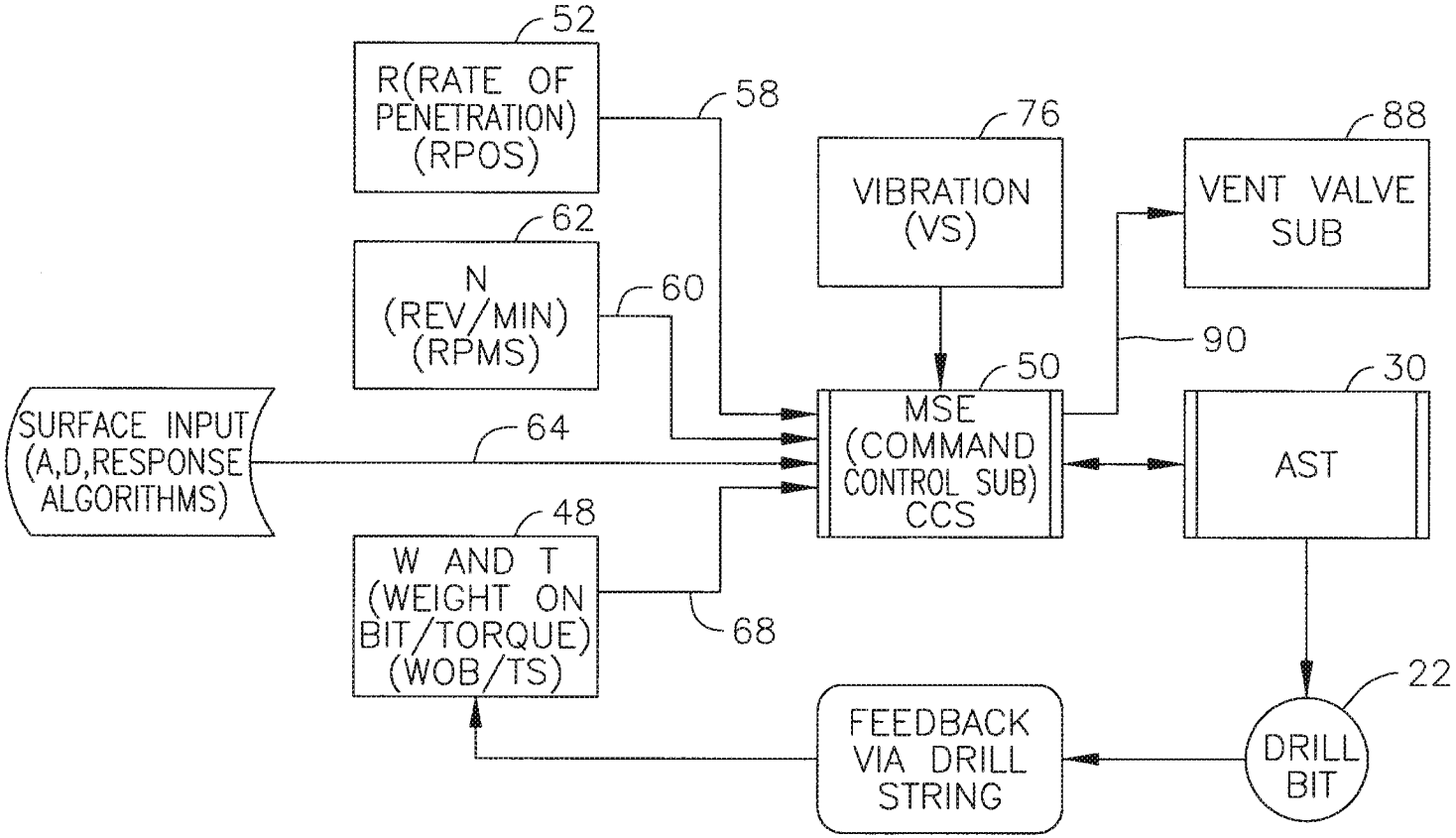
FIG. 7 is a flow diagram of the function of the system of FIG. 2 further incorporating a vent valve sub.

The MSE-DDA of the present invention can also incorporate adjustable hydraulics as shown in FIG. 7. In this embodiment, the MSE-DDA system is primarily designed for operation in horizontal wells in which unique drilling hydraulic conditions allow this configuration to operate. When drilling horizontally, the typical problem is hole cleaning rather than adequate bit hydraulics. One drilling method is to provide excessive amounts of fluid to the bottom of the hole with a drilling mud with exceptional cutting-carrying capability, such as a thixotropic mud, and hope that the fluid velocities are sufficient to carry the cuttings to the vertical section and up the hole. A common problem is that cuttings transport is poor and that excessive bit hydraulics results in excessive erosion of the drill bit, shortening its life and ultimately requiring a trip to the surface to replace the bit. This type of drilling condition, does not directly affect the MSE, but it does reduce ROP because frequent wiper trips to the build section of the well are required in keeping the hole clean.

Therefore, when encountering this type of drilling conditions, it would be advantageous that not all the drilling mud be delivered to the drill bit; preferably, if some of the drilling fluid were to be exhausted into the annulus at a distant location from the drill bit it would provide the benefits of reducing bit erosion and improving hole cleaning.

Another condition that is encountered when drilling long horizontal wells is insufficient hydraulics for proper bit cleaning. For example, this condition arises when drilling in sandstone and intercepting a shale stringer. A bit that was appropriate for sandstone will be too aggressive for shale, producing too great a cutting load on the bit, resulting in bit balling (in adequate cleaning) which reflects as an increase in the Mechanical Specific Energy. Therefore, if additional hydraulics were applied rapidly after encountering a shale stringer or other bit-formation interaction that produced excessive cuttings, Mechanical Specific Energy would be reduced and ROP would be increased. Thus both inadequate and excessive hydraulics at the drill bit affect ROP and in some conditions the MSE.

To address these conditions, the MSE-DDA, as illustrated in FIG. 7 includes the ability to adjust hydraulics by incorporating a vent valve sub (VVS) 88 that dynamically adjusts the fluid flow. The VVS 88 is a motorized flow control valve that responds to signals 90 from the CCS 50 and regulates the flow both to the annulus 92 and to the drill bit 22. Under typical conditions, the VVS allows a majority of the drilling mud to exit the drill bit, thus cleaning the bit and another smaller percentage to exit a port in the VVS into the annulus, helping to clean and move cutting. When the CCS determines a non-optimum (increasing) MSE, it give a command to the VVS to adjust (increase) the hydraulics delivered to the bit, thus increasing the cleaning of the cuttings under the bit, and resulting in lowering the MSE. This process is done dynamically as the drilling process continues, thus dynamically increasing the drilling efficiency.

Some of the benefits of the present invention include:

Fast Rate of Penetration (ROP)/Cost Reduction: The greatest financial benefit of the system is the direct increase in drilling efficiency which results in lower cost per foot of drilling, a common measure of normalizing drilling costs. For example, a 20% increase in average ROP could result in a 10% cost reduction for drilling the well.

Available in Wide Range of Sizes: The system can be adjusted for a wide range to typical drilling assemblies ranging from 3 inches to 17.5 inches.

Field Adjustability: The system specifically allows for the calibration of the system while in the field. The system has access ports to allow input of specific parameters related to the particular well including bit diameter, hole area, modification of command threshold points on all anticipated drilling conditions and required responses, thereby allowing the tool to "get smarter" with each operation in similar wells.

Compatibility with Existing Drilling Methods: The system is completely compatible with existing drilling methods and equipment. No significant changes in typical drilling operations are required, thereby allowing prompt and efficient use of the tool and technology.

Reduction in Requirements for Expert Advice for Drilling: When empirically verified, the optimized drilling conditions for a well or field, the optimum drilling parameters can be included in the control algorithms thereby reducing the number of drilling conditions that require expert help for the field personnel and thereby reducing costs per well.

Increased Drilling Efficiency: With the system, weight is controlled immediately at the drill bit thereby providing greater efficiency than systems controlled entirely at the surface. Parasitic losses from the surface are up 75-90% of the drilling energy, but the invention herein virtually delivers 95-100% of its energy directly to the drill bit.

While the present invention has been described and illustrated with respect to various embodiments disclosed herein, it is to be understood that the invention should not be so limited as changes and modifications can be made which are intended to be within the scope of the claims as hereinafter stated.

What is claimed is:

1. A downhole drilling assembly comprising;

a bottom hole assembly including drill pipe and a drill bit;

downhole means for sensing torque at the drill bit, weight on bit and revolutions per minute of the drill bit;

a computerized computation means positioned downhole as a component of the bottom hole assembly for receiving input from the means for sensing and determining instantaneous mechanical specific energy of the downhole drilling assembly; and a controlled weight modification tool positioned downhole as a component of the bottom hole assembly responsive to a signal from the computerized computation means based upon real time mechanical specific energy to adjust the weight on bit to maximize rate of penetration of the drill bit.

2. The assembly of claim 1 wherein the computerized computation means is further programmed with bit aggressiveness data, area of hole information, drilling fluid properties information and bit diameter information to calculate the mechanical specific energy.

3. The assembly of claim 1 wherein the assembly forms a downhole feedback loop to continually self-adjust drilling parameters to minimize the mechanical specific energy.

4. The assembly of claim 1 wherein the bottom hole assembly further comprises a measurement while drilling tool to determine location of the bottom hole assembly.

5. The assembly of claim 1 wherein the means for sensing torque and weight on bit is a weight on bit and torque sub.

6. The assembly of claim 1 wherein the computerized computation means is a command and control sub.

7. The assembly of claim 1 wherein the controlled weight modification tool is an anti-stall tool.

8. The assembly of claim 1 wherein the bottom hole assembly further includes a rate of penetration sub for measuring axial velocity of the bottomhole assembly.

9. The assembly of claim 1 wherein the weight on bit and torque sub, command and control sub and rate of penetration sub is a single component.

10. The assembly of claim 6 wherein the bottom hole assembly further includes a vibration sub for monitoring axial, lateral and torsional vibration of the bottom hole assembly which sends a vibration signal to the command and control sub for processing.

11. The assembly of claim 4 wherein the measurement while drilling tool includes surface communication interfacing controls.

12. The assembly of claim 11 wherein the surface communication interfacing controls is via mud pulse telemetry.

13. The assembly of claim 1 further comprising a vent valve sub to dynamically adjust drilling fluid flow to the drill bit and into an annulus of a drill bore in horizontal drilling conditions.

14. A mechanical specific energy downhole drilling assembly comprising:

a bottom hole assembly including drill pipe and a drill bit;

at least one sensing sub positioned between the drill pipe and the drill bit for sensing weight on bit, torque of the bit, and revolutions per minute of the drill pipe;

a computation sub in the bottom hole assembly for computing mechanical specific energy of the assembly based at least in part on a weight on bit signal, a torque signal and a revolutions per minute signal from the sensing sub; and an anti-stall tool positioned between the drill pipe and the drill bit for adjusting weight on bit pursuant to a command from the computation sub.

15. The assembly of claim 14 wherein the computation sub also computes mechanical specific energy from programmed information regarding bit aggressiveness, area of hole, drilling fluid properties and bit diameter.

16. The assembly of claim 14, wherein the sensing sub comprises a weight on bit and torque sub.

17. The assembly of claim 14, further comprising a rate of penetration sub for measuring axial velocity of the bottom hole assembly.

18. The assembly of claim 14, further comprising a measurement while drilling tool to determine location of the bottom hole assembly.

19. The assembly of claim 14 further comprising a vibration sub for monitoring axial, lateral and torsional vibration of the bottom hole assembly.

20. The assembly of claim 14 further comprising a vent valve sub to dynamically adjust drilling fluid flow to the drill bit and into an annulus of a drill bore in horizontal drilling conditions.

* * * * *